United States Patent [19]

Yoshitomi et al.

[11] 4,119,053

[45] Oct. 10, 1978

[54] STEERING MECHANISM FOR INBOARD-OUTBOARD MARINE DRIVE

[75] Inventors: Masahide Yoshitomi, Yokohama; Atsuo Yonekura, Yamato, both of Japan

[73] Assignee: Kabushiki Kaisha Komatsu Seisakusho, Tokyo, Japan

[21] Appl. No.: 862,587

[22] Filed: Dec. 20, 1977

[30] Foreign Application Priority Data

Dec. 20, 1976 [JP] Japan ..... 51-152018
Dec. 20, 1976 [JP] Japan ..... 51-152019

[51] Int. Cl.[2] ..... B63H 25/42
[52] U.S. Cl. ..... 115/35; 115/41 HT
[58] Field of Search ..... 115/34 R, 35, 41 R, 115/41 HT

[56] References Cited

U.S. PATENT DOCUMENTS

| | | | |
|---|---|---|---|
| 3,136,287 | 6/1964 | North | 115/41 R |
| 3,339,517 | 9/1967 | Bergstedt | 115/41 R |
| 3,368,517 | 2/1968 | MacDonald et al. | 115/41 R |

*Primary Examiner*—Trygve M. Blix
*Assistant Examiner*—Jesus D. Sotelo
*Attorney, Agent, or Firm*—Armstrong, Nikaido, Marmelstein & Kubovcik

[57] ABSTRACT

A steering mechanism for inboard-outboard marine drive including an inboard engine and a power leg having a propeller rotatably mounted thereon, the power leg being adapted to be located outboard of the hull of a vessel and drivingly connected to the engine. The steering mechanism comprises a stern plate mounted on the vessel, a gimbal rotatably mounted about a horizontal axis on the stern plate, the power leg being fixedly secured to the gimbal at the lower and upper ends thereof, a tiller axis mounted on and through the stern plate, and a steering arm connected at its upper end to the tiller axis through a universal joint, the steering arm being divided into two parts and adapted to be pivoted with each other, lower end of the steering arm being connected to the power leg through another universal joint.

6 Claims, 4 Drawing Figures

STEERING MECHANISM FOR INBOARD-OUTBOARD MARINE DRIVE

BACKGROUND OF THE INVENTION

This invention relates to inboard-outboard marine drive units for boats wherein an inboard engine has a rearwardly extending drive shaft coupled through universal joints to power transmission in an outboard power leg. The outboard power leg is carried aft of the stern and is mounted for pivoting on two mutually and generally perpendicular axes.

It is therefore free to swing laterally for steering the boat while also being free to swing vertically such that the lower end thereof may move rearwardly and upwardly in a tilting motion.

Conventionally, however, since the power leg is supported by a gimbal only at one portion, which in turn is rotatably mounted about a horizontal axis on the stern of the boat, a heavy load is applied to the supporting portion and a breakage is likely to be occured at that portion.

SUMMARY OF THE INVENTION

It is therefore an object of the present invention to provide an improved steering mechanism for an inboard-outboard marine drive.

Another object of the present invention is to provide a steering mechanism for an inboard-outboard marine drive wherein a power leg is supported at two spaced portions by a gimbal to minimize a possible breakage of the supporting portion.

In accordance with an aspect of the present invention, there is provided a steering mechanism for inboard-outboard marine drive units including an inboard engine and a power leg having a propeller rotatably mounted thereon, said power leg being adapted to be located outboard of the hull of a boat and to be drivingly connected through transmission means to said engine.

The steering mechanism comprises a stern plate mounted on said boat, gimbal means rotatably mounted about a horizontal axis on said stern plate, first securing means for fixedly securing said power leg to said gimbal means at the lower end thereof, and second securing means for fixedly securing said power leg to said gimbal means at the upper end thereof, axes of said first and second securing means being vertically aligned with each other. A tiller axis is mounted on and through said stern plate.

A steering arm means is connected at its upper end to said tiller axis through a universal joint means, said steering arm means being divided into two parts and adapted to be pivoted with each other, the lower end of said steering arm means being connected to said power leg through another universal joint means. The tiller axis lies in a plane formed by the axes of said first and second securing means and the input axis of said transmission means. In the preferred embodiment, since the centers of said universal joints provided in said steering arm means are equally displaced from a point of intersection of the axes of said securing means and a reference line extending from said tiller axis, steering angle of the power leg is directly proportional to that of a tiller mounted on the tiller axis.

The above and other objects, features and advantages of the present invention will be readily apparent from the following description taken in conjunction with the accompanying drawings in which same reference numbers indicate identical and similar parts throughout the description.

DETAILED DESCRIPTION OF THE INVENTION

Figure 1:
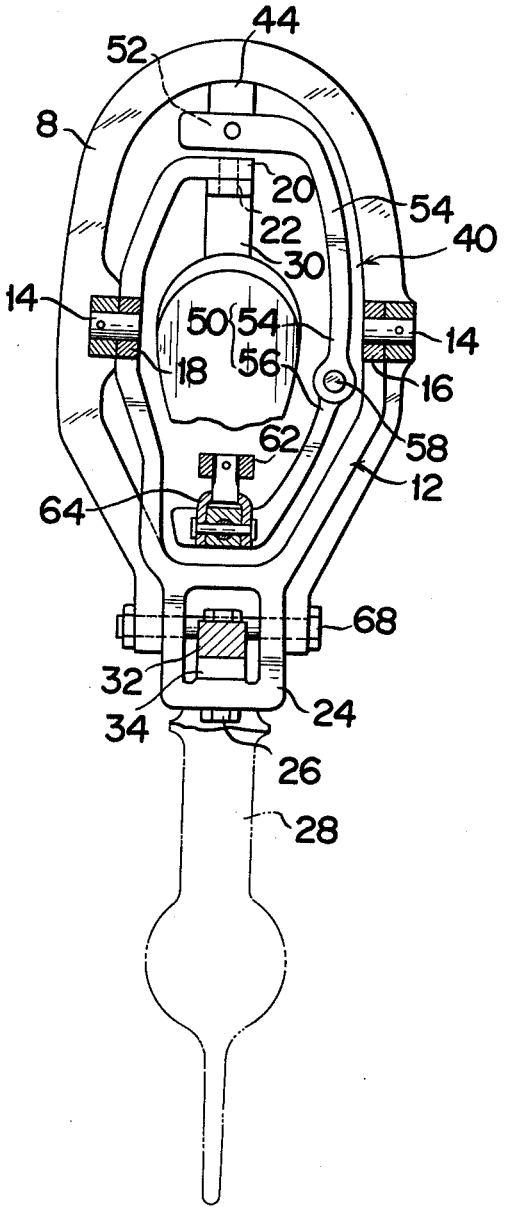
FIG. 1 is a rear elevational view partially in cross-section of a steering mechanism for marine drive according to the present invention.
Figure 2:
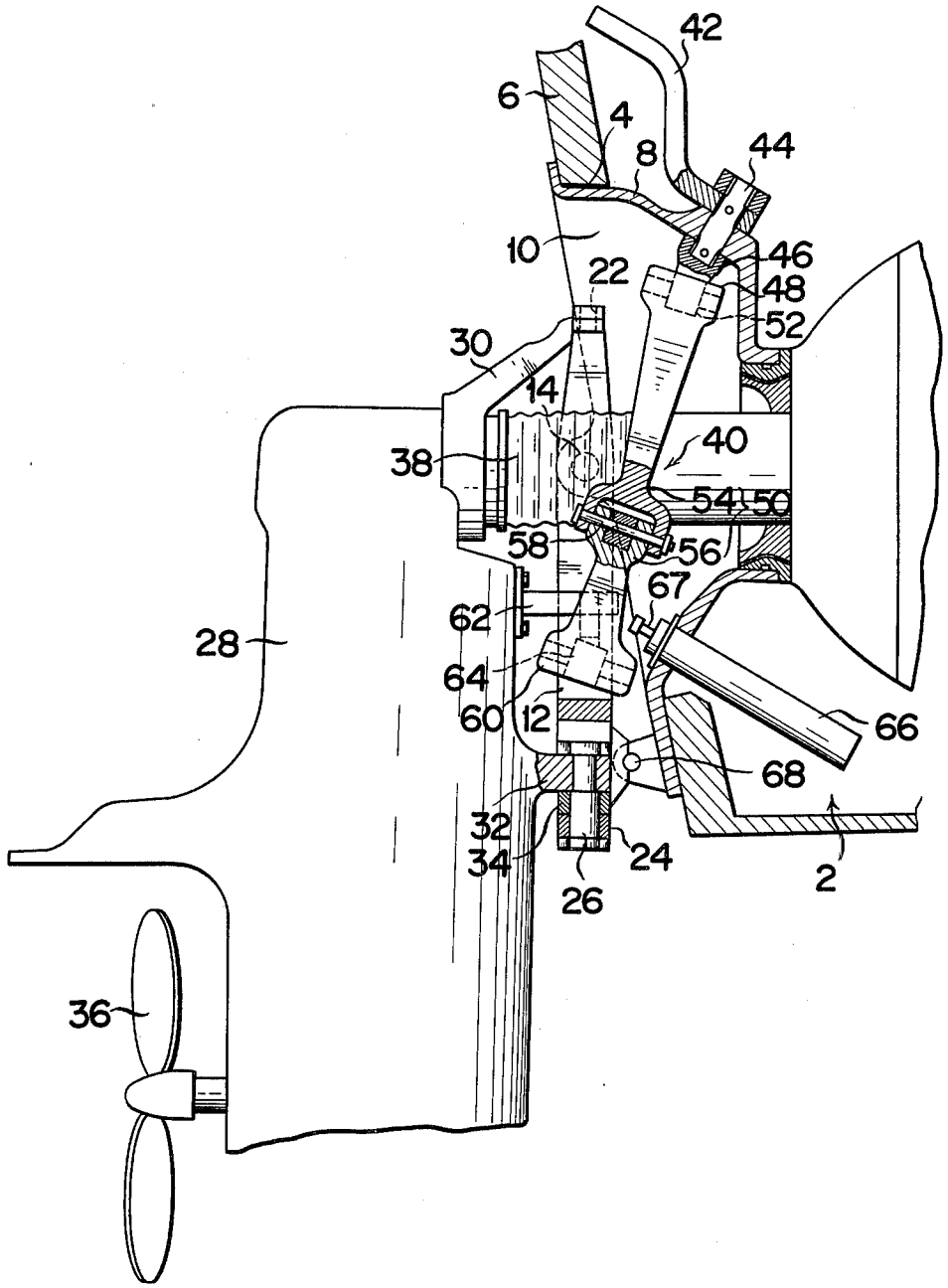
FIG. 2 is a side elevational view of FIG. 1 partially in cut-away with the stern plate, the tiller axis and the steering axes of the securing means being cross-sectioned.

The present invention will now be described with reference to the accompanying drawings. Referring to FIGS. 1 and 2, reference numeral 2 denotes a boat in which an inboard engine (not shown) is mounted.

A mounting opening 4 is formed in a transom 6 of the boat 2 in which a stern plate 8 is mounted in liquid tight or water proof manner. Center portion of the stern plate 8 is bulged toward inboard providing a recessed room 10 inside the stern plate 8 in which a gimbal 12 is mounted. The gimbal 12 is rotatably supported about a horizontal axis 14 for tilting motion at the upper end 16 of one of the side portions thereof and an intermediate portion 18 of the other side portion thereof by side portions of the stern plate 8.

The gimbal 12 is generally three quarters generally oval in shape as can be seen in FIG. 1 and the upper end 20 of the other side portion thereof is formed as a steering axis 22.

A yoke 24 is formed in the lower portion of the gimbal 12 as an integral part thereof and another steering axis 26 is formed in the yoke 24, which steering axis 26 is vertically aligned with the steering axis 22.

A power leg 28 is supported by the steering axes 22, 26 and free to swing laterally thereabout through an upper supporting portion 30 and a lower supporting portion 32 so as to provide a strong connection of the power leg 28 with the gimbal 12. A spacer 34 is interposed between the lower supporting portion 32 of the power leg 28 and the yoke 24 of the gimbal 12.

A propeller 36 is rotatably mounted on the rear end of the power leg 28 and is drivingly connected to the inboard engine (not shown) through transmission means. The transmission means includes a power input shaft and double universal joints which are covered by a bellows like boot 38 so as to protect the transmission means from the water.

The center of the double universal joints is preferably positioned on the tilt axis 14. A steering mechanism for the inboard-outboard marine drive is generally indicated at 40 and comprises as follows.

A tiller 42 operatively connected with a steering handle (not shown) is splined on a tiller axis 44 which in turn is rotatably mounted on and through the stern plate 8. The lower end 46 of the tiller axis 44 is connected with the upper end 48 of a steering arm 50 through a universal joint 52. The steering arm 50 is formed in arc shape and is divided into two parts at a slightly lower portion than the intermediate portion thereof. An upper steering arm 54 and a lower steering arm 56 are connected by a pin 58 and are adapted to pivot with each other. The lower end 60 of the lower steering arm 56 is pivotally connected with a bracket 62 extended from the power leg 28 through a universal joint 64.

Out of cross-axes of the universal joints 52 and 64, each one of the axis is extended parallel to the pin 58. The tiller axis 44 lies in a plane formed by the steering axes 22, 26 and the power input axis while the centers of the universal joints 52, 64 are equally displaced from a point of intersection of the steering axes 22, 26 and a reference line extending from the tiller axis 44.

Reference numeral 66 is a tilt cylinder having a piston rod 67 mounted therein for tilting the gimbal 12 about the horizontal tilt axis 14 and 68 is a thrust receiving pin for transmitting a part of thrust force produced by the propeller 36 to the boat 2.

In the operation, when the tiller 42 is rotated to a certain angle, the power leg 28 is rotated to the same angular amount about the steering axes 22, 26 to that of tiller 42 through the tiller axis 44 and the steering arm 50.

As to the tilting movement of the power leg 28, when the piston rod 67 of the cylinder 66 is extended toward and against the gimbal 12, the power leg 28 is rotated rearwardly and upwardly about the horizontal tilt axis 14.

During the tilting motion of the power leg 28, the upper steering arm 54 and the lower steering arm 56 are pivoted with each other about the pin 58 so as to adjust the distance between the universal joints 52 and 64 as well as to avoid collision of the steering arm 50 with the transmission means covered by the bellows boot 38.

Figure 3:
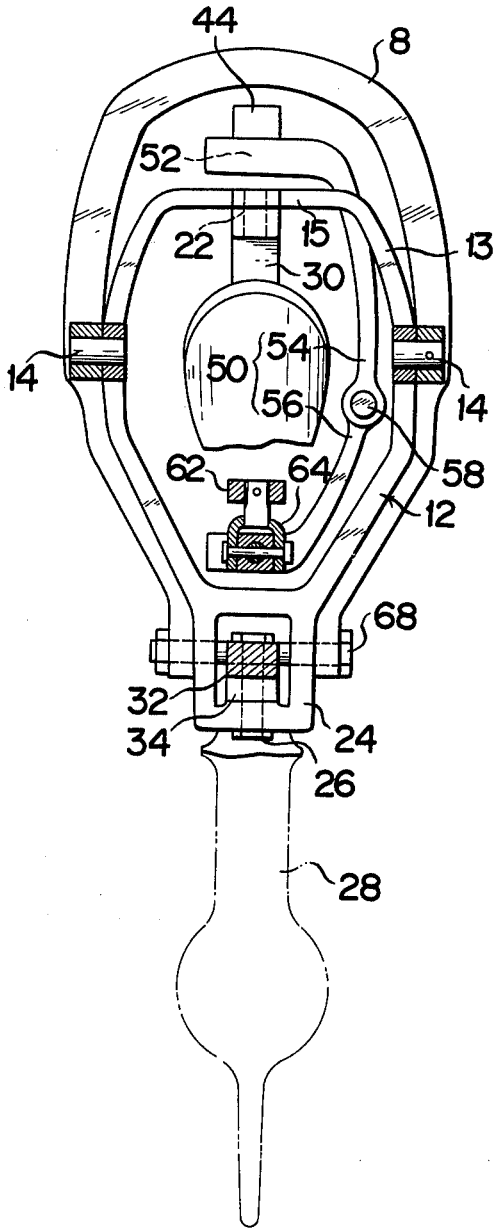
FIG. 3 is similar to FIG. 1 but showing another embodiment of the steering mechanism according to the present invention.
Figure 4:
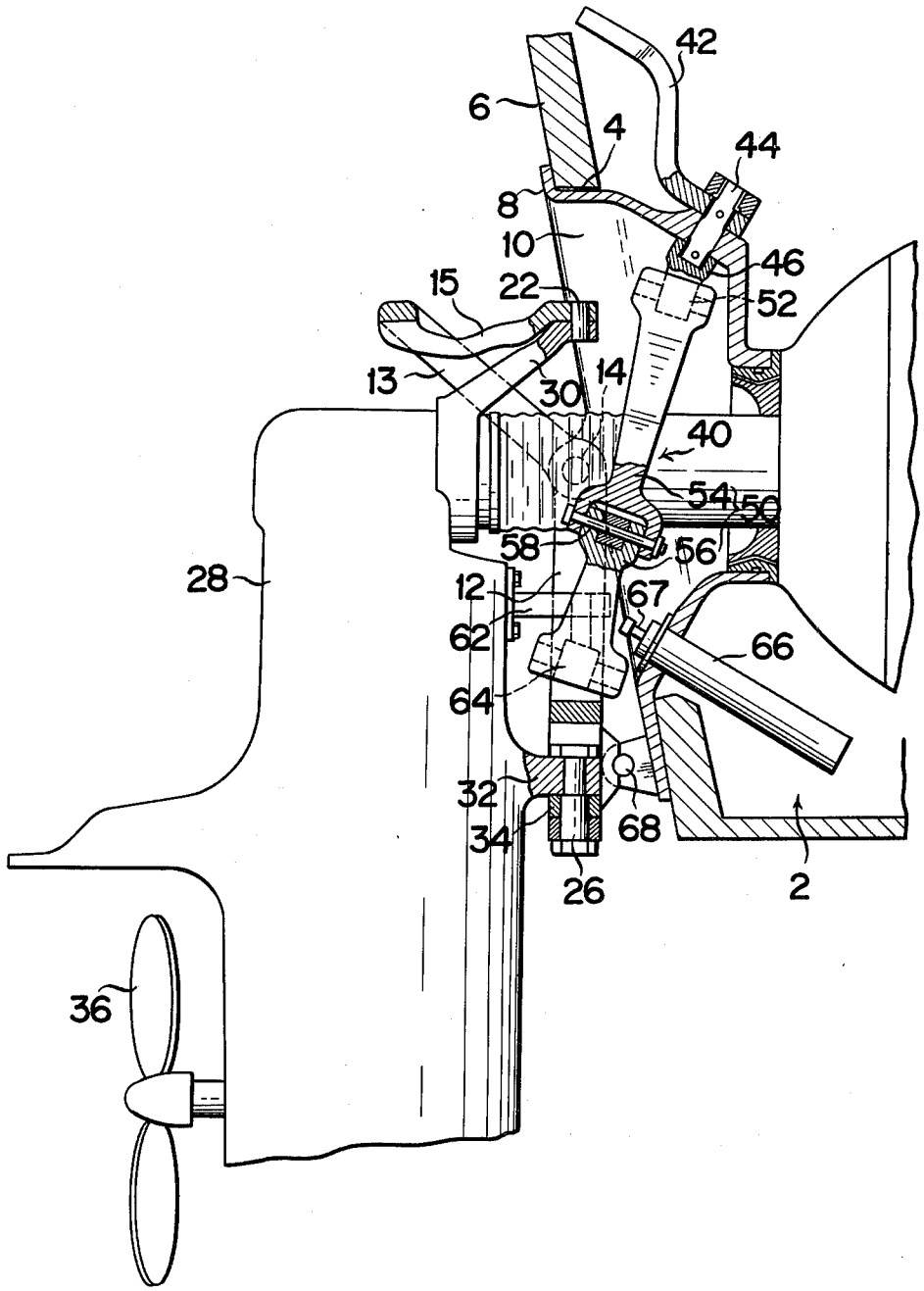
FIG. 4 is similar to FIG. 2 but showing the embodiment of FIG. 3.

Referring to FIGS. 3 and 4, there is disclosed another embodiment of the present invention.

This embodiment differs only from previously described embodiment in the shape of the gimbal 12. The gimbal 12 of this embodiment is generally oval shape with upper portion 13 thereof above the tilt axis 14 being rearwardly and upwardly extended so as to avoid collision thereof with the steering arm 50.

Further top portion 15 of the gimbal 12 is again forwardly extended for rotatably supporting the power leg 28 about the steering axis 22. Since other constructions of this embodiment are almost identical to those of previously described embodiment, explanation in this regard is omitted here.

Further operation of this embodiment is almost identical to that of the foregoing embodiment, therefore explanation in this regard is omitted too.

While the steering mechanism for the marine drive in accordance with the present invention has been shown and described in terms of its specific forms, it is understood that the invention itself is not to be restricted by the exact details of this disclosure. Numerous modifications or changes will readily occur to those skilled in the art without departing from the spirit or scope of the invention as sought to be defined by the following claims.

What is claimed is:

1. In a steering mechanism for inboard-outboard marine drive units including an inboard engine and a power leg having a propeller rotatably mounted thereon, said power leg being adapted to be located outboard of the hull of a vessel and to be drivingly connected through transmission means having an input axis and first universal joint means to said engine;

the improvement comprising a stern plate mounted on said vessel, gimbal means rotatably mounted about a horizontal axis on said stern plate, first securing means for fixedly securing said power leg to said gimbal means at the lower end thereof, second securing means for fixedly securing said power leg to said gimbal means at the upper end thereof, axes of said first and second securing means being vertically aligned with each other, a tiller axis mounted on and through said stern plate, said tiller axis having a tiller mounted thereon, and steering arm means connected at its upper end to said tiller axis through second universal joint means, said steering arm means being divided into two parts and adapted to be pivoted with each other, lower end of said steering arm means being connected to said power leg through third universal joint means.

2. The steering mechanism for inboard-outboard marine drive as defined in claim 1 wherein said tiller axis lies in a plane formed by the axes of said first and second securing means and the input axis of said transmission means.

3. The steering mechanism for inboard-outboard marine drive as defined in claim 1 wherein said steering arm means is formed arc-like in shape so as to avoid collision thereof with said transmission means.

4. The steering mechanism for inboard-outboard marine drive as defined in claim 3 wherein said gimbal means is generally three quarters oval in shape with an opening formed at and around the upper half part of said steering arm means so as to avoid collision therewith.

5. The steering mechanism for inboard-outboard marine drive as defined in claim 3 wherein said gimbal means is oval in shape with the upper half part of said gimbal means being inclined rearwardly and upwardly so as to avoid collision thereof with said steering arm means.

6. The steering mechanism for inboard-outboard marine drive as defined in claim 1 wherein the centers of said second and third universal joints are equally displaced from a point of intersection of the axes of said securing means and a reference line extending from said tiller axis.

* * * * *